US008157016B2

(12) United States Patent
James

(10) Patent No.: US 8,157,016 B2
(45) Date of Patent: Apr. 17, 2012

(54) FLUID METERING DEVICE AND METHOD FOR WELL TOOL

(75) Inventor: Paul G. James, Spring, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 308 days.

(21) Appl. No.: 12/390,758

(22) Filed: Feb. 23, 2009

(65) Prior Publication Data

US 2010/0212910 A1 Aug. 26, 2010

(51) Int. Cl.
*E21B 34/10* (2006.01)

(52) U.S. Cl. ..... 166/375; 166/374; 166/386; 166/320

(58) Field of Classification Search ..... 166/374, 166/375, 386, 320, 334.1, 334.4; 220/389, 220/394
See application file for complete search history.

(56) References Cited

U.S. PATENT DOCUMENTS

| | | | | |
|---|---|---|---|---|
| 2,770,308 | A | 11/1956 | Saurenman | |
| 3,763,885 | A | 10/1973 | Sussman | |
| 4,132,205 | A | 1/1979 | Merritt | |
| 4,180,239 | A | 12/1979 | Valukis | |
| 5,238,070 | A | 8/1993 | Schultz et al. | |
| 5,564,501 | A | 10/1996 | Strattan et al. | |
| 5,746,413 | A | 5/1998 | Goloff | |
| 5,897,095 | A | 4/1999 | Hickey | |
| 5,906,220 | A | 5/1999 | Thompson | |
| 6,276,458 | B1 | 8/2001 | Malone et al. | |
| 6,470,970 | B1 * | 10/2002 | Purkis et al. | 166/374 |
| 6,536,530 | B2 | 3/2003 | Schultz et al. | |
| 6,585,051 | B2 | 7/2003 | Purkis et al. | |
| 7,013,980 | B2 * | 3/2006 | Purkis et al. | 166/386 |
| 2006/0254763 | A1 * | 11/2006 | Tips et al. | 166/65.1 |
| 2008/0173454 | A1 * | 7/2008 | Smithson et al. | 166/324 |
| 2010/0038092 | A1 * | 2/2010 | Powell et al. | 166/375 |

FOREIGN PATENT DOCUMENTS

| | | | |
|---|---|---|---|
| FR | 2270468 | A1 | 12/1975 |
| GB | 1135895 | A | 12/1968 |
| GB | 1345867 | A | 2/1974 |
| GB | 2335216 | A | 9/1999 |

OTHER PUBLICATIONS

PCT Written Opinion issued Jan. 14, 2008, by the International Preliminary Examining Authority for International Patent Application No. PCT/US00/014027, 5 pages. PCT International Preliminary Examination Report issued May 28, 2008, by the International Preliminary Examining Authority for International Patent Application No. PCT/US00/14027, 6 pages.
Canadian Office Action issued Jul. 29, 2011 for CA Patent Application No. 2,692,670, 2 pages.

* cited by examiner

*Primary Examiner* — Jennifer H Gay
*Assistant Examiner* — Elizabeth Gottlieb
(74) *Attorney, Agent, or Firm* — Marlin R. Smith

(57) ABSTRACT

A method of actuating a well tool includes the steps of: increasing pressure in a fluid line of a fluid metering device; closing a pilot-operated valve in response to the pressure increasing step; and discharging a predetermined volume of fluid from the metering device in response to the pressure increasing and valve closing steps. A fluid metering device for a well tool includes a piston separating chambers; and a pilot-operated valve which selectively prevents fluid communication between the chambers in response to at least a predetermined pressure being applied to a fluid line of the metering device, and which permits fluid communication through the valve between the chambers in response to pressure in the fluid line being less than the predetermined pressure. A greater pressure may be applied to the fluid line to thereby bypass the metering device and allow fluid to discharge from the line.

17 Claims, 5 Drawing Sheets

FLUID METERING DEVICE AND METHOD FOR WELL TOOL

BACKGROUND

This disclosure relates generally to equipment utilized and operations performed in conjunction with a subterranean well and, in an example described below, more particularly provides a fluid metering device and associated method for use with well tools.

Various types of well tools can be operated in response to flowing a known volume of fluid into, out of or through the tool or an actuator for the tool. For example, a choke or sliding sleeve valve can be incrementally opened and/or closed by flowing a known volume of fluid into or out of an actuator. This can be done multiple times, if needed, to open or close the choke or valve by a desired amount.

Although some devices have been developed in the past for metering a known volume of fluid to operate a well tool, these devices have tended to be expensive and difficult to produce, in part due to the requirement for precision machined specialty components which make up the devices. As always, there is a need to lower costs and enhance production in this industry.

Therefore, it will be appreciated that improvements are needed in the art of fluid metering devices and methods for operating well tools.

SUMMARY

In this specification, devices and methods are provided which solve at least one problem in the art. One example is described below in which a fluid metering device includes readily available components configured in a unique manner to achieve accurate and reliable operation of a downhole well tool. Another example is described below in which the well tool can still be operated, even if the fluid metering device malfunctions (for example, a piston therein being stuck), or if it becomes desirable to bypass the fluid metering device.

In one aspect, a unique method of operating a well tool is provided by this disclosure. The method includes the steps of: increasing pressure in a fluid line of a fluid metering device; closing a pilot-operated valve in response to the pressure increase; and discharging a predetermined volume of fluid from the metering device in response to the pressure increase and the valve closing.

In another unique aspect, a fluid metering device is provided for a well tool. The fluid metering device includes a piston separating chambers in the device, and a pilot-operated valve which selectively prevents fluid communication between the chambers in response to a predetermined pressure being applied to a fluid line of the metering device. The valve also permits fluid communication through the valve between the chambers in response to pressure in the fluid line being less than the predetermined pressure.

Also provided by this disclosure is a well tool which includes an actuator for operating the well tool, and the fluid metering device connected to the actuator. The metering device can be connected to an input of the actuator (for example, between the actuator and a pressure source). Alternatively, or in addition, the metering device can be connected to an output of the actuator.

These and other features, advantages and benefits will become apparent to one of ordinary skill in the art upon careful consideration of the detailed description of representative examples below and the accompanying drawings, in which similar elements are indicated in the various figures using the same reference numbers.

DETAILED DESCRIPTION

Figure 1:
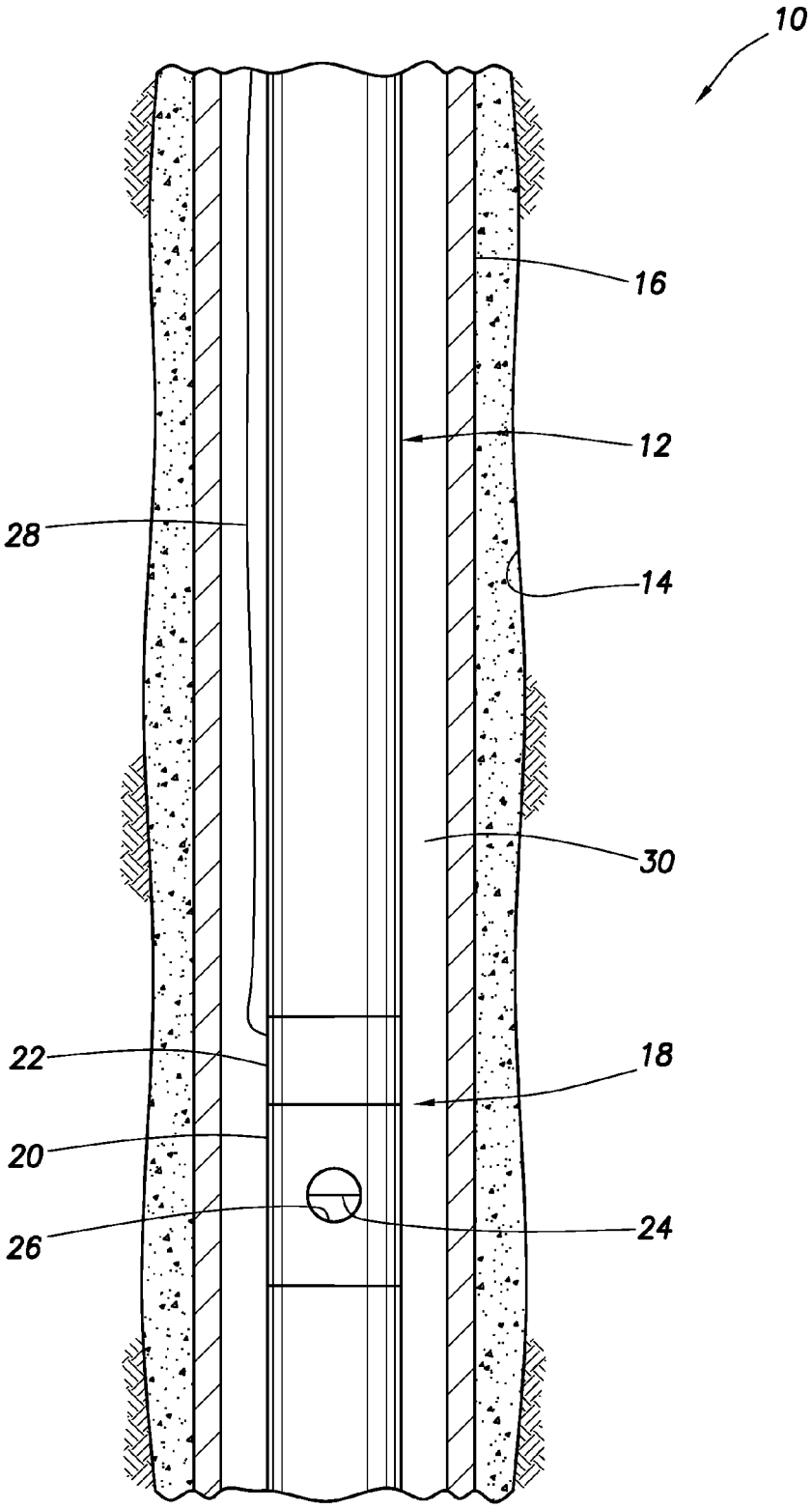
FIG. 1 is a schematic partially cross-sectional view of a well system and method embodying principles of this disclosure.

Representatively illustrated in FIG. 1 is a well system 10 which embodies principles of this disclosure. The well system 10 includes a tubular string 12 (such as a production tubing string) positioned in a wellbore 14 lined with casing 16.

Of course, the well system 10 is just one example of a wide variety of different well systems which could take advantage of the principles of this disclosure. For example, it is not necessary for the wellbore 14 to be completely cased (since portions of the wellbore could be uncased or open hole), the tubular string 12 could be a drill string, test string, completion string, work string, injection string, or any other type of tubular string.

As depicted in FIG. 1, a well tool 18 is interconnected in the tubular string 12. In this example, the well tool 18 includes a flow control device 20 and an actuator 22 for operating the flow control device.

However, it should be clearly understood that the well tool 18 is merely an example of a wide variety of well tools which could make use of the principles of this disclosure. For example, the well tool 18 could instead be a packer, hanger, setting tool, sampler, tester, injector or any other type of well tool, and it is not necessary for the well tool to be interconnected in any tubular string.

In the example of FIG. 1, the flow control device 20 includes a closure 24 (such as a sliding sleeve, choke trim, etc.) which is incrementally displaced upward and downward by the actuator 22 to vary flow through one or more ports 26 of the flow control device. The well tool 18 includes a fluid metering device (described below, not visible in FIG. 1) which responds to pressure applied via a control line 28 to flow a certain volume of fluid through the actuator 22 and thereby displace the closure 24 a known distance and produce a known change in flow through the ports 26.

However, the pressure could be applied from other pressure sources. For example, the pressure source could be a downhole pump, a pressurized chamber, an annulus 30 formed between the tubular string 12 and the casing 16, an interior flow passage of the tubular string, etc. Any type of pressure source may be used in keeping with the principles of this disclosure.

Figure 2:
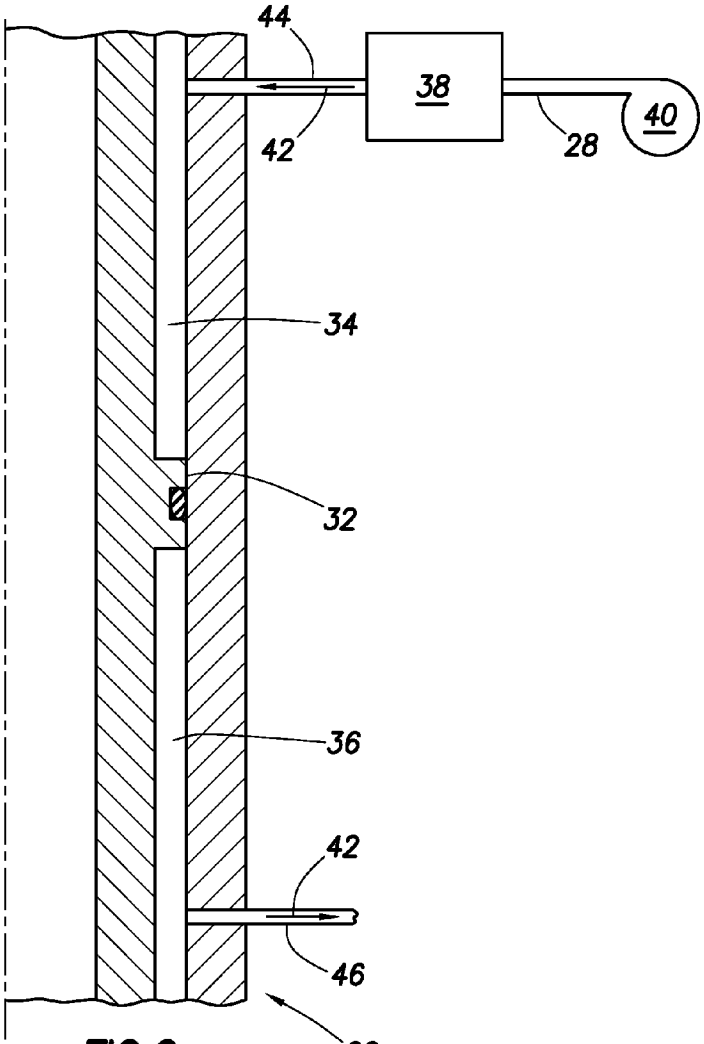
FIG. 2 is an enlarged scale schematic partially cross-sectional view of a well tool actuator and a fluid metering device which may be used in the system of FIG. 1.

Referring additionally now to FIG. 2, an enlarged scale schematic view of the actuator 22 is representatively illustrated. In this view, it may be seen that the actuator 22 includes a piston 32 which displaces in response to a pressure differential between two chambers 34, 36 on opposite sides of the piston. The piston 32 is connected to the closure 24, so that displacement of the piston causes displacement of the closure.

Also depicted in FIG. 2 are a fluid metering device 38 and a pressure source 40. The fluid metering device 38 could be separate from the actuator 22, or it could be a part of the actuator, as desired.

The pressure source 40 could be any type of pressure source, as discussed above, and it may be connected to the fluid metering device 38 via the control line 28. Alternatively, the pressure source 40 could be directly connected to the fluid metering device 38, or it could be otherwise connected, if desired.

Pressure applied from the pressure source 40 to the metering device 38 causes a known volume of fluid 42 to be discharged from the metering device into the chamber 34 via a line 44. This, in turn, causes the piston 32 to displace downwardly as viewed in FIG. 2, causing the volume of fluid 42 to also be discharged from the chamber 36 via another line 46.

Of course, the actuator 22 is merely one example of a wide variety of actuators which can utilize the principles of this disclosure. For example, the piston 32 is not necessarily annular-shaped, the actuator 22 could be a rotary or other type of actuator, etc.

Furthermore, it is not necessary for the metering device 38 to be used in conjunction with an actuator at all. Instead, the metering device 38 could be used to incrementally pressurize a chamber, to discharge fluid at a controlled rate, or to perform other functions without use of an actuator.

Figure 3:
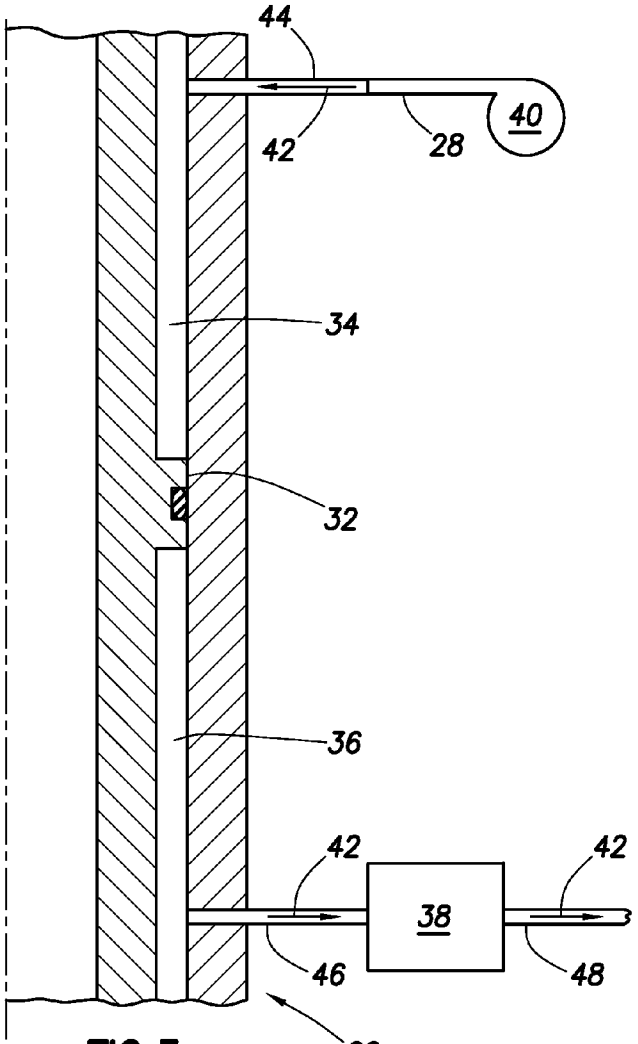
FIG. 3 is a schematic partially cross-sectional view of another configuration of the well tool actuator and fluid metering device.

Referring additionally now to FIG. 3, another configuration of the actuator 22, metering device 38 and pressure source 40 is representatively illustrated. In this configuration, the metering device 38 is not connected between the pressure source 40 and the actuator 22, but is instead connected to the line 46.

The pressure source 40 applies pressure to the chamber 34 via the lines 28, 44 and this pressure is transmitted from the chamber 34 to the chamber 36 by the piston 32. The pressure is applied to the metering device 38 via the line 46, and in response, the metering device discharges a known volume of the fluid 42 via another line 48, thereby allowing the piston 32 to displace downwardly a certain distance.

FIGS. 2 & 3 depict just two possible configurations of the metering device 38, pressure source 40 and actuator 22, but many other configurations are possible. For example, multiple metering devices 38 could be used (e.g., a metering device connected to the chamber 34, and another metering device connected to the chamber 36, in order to incrementally displace the piston 32 both upward and downward), multiple pressure sources 40 could be used, a control module (not shown) could be used to selectively apply pressure from the pressure source(s) to the metering device(s), etc.

Various suitable metering device, pressure source and actuator configurations are described in U.S. Pat. No. 6,585,051. The entire disclosure of this prior patent is incorporated herein by this reference for all purposes.

Figure 4:
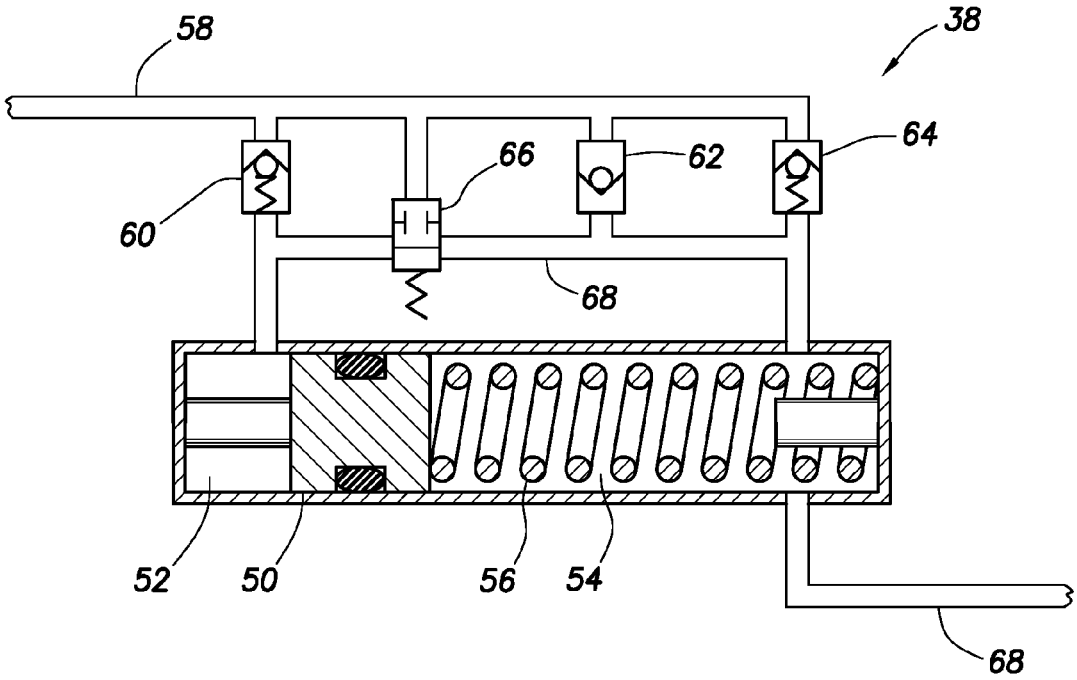
FIGS. 4-8 are schematic hydraulic circuit diagrams for the fluid metering device which may be used in the well tool, and which embodies principles of this disclosure.

Referring additionally now to FIG. 4, a schematic hydraulic circuit diagram for the metering device 38 is representatively illustrated. In this view it may be seen that the metering device 38 includes a piston 50 which separates two chambers 52, 54. The piston 50 is biased toward the chamber 52 (to the left as viewed in FIG. 4) by a biasing device 56 (such as, a spring, pressurized chamber, etc.).

A fluid line 58 is connected to the chambers 52, 54 via a relief valve 60, a check valve 62 and another relief valve 64. In addition, a normally open pilot-operated valve 66 is interconnected in a line 68 which provides a flowpath for fluid communication between the chambers 52, 54.

Figure 5:
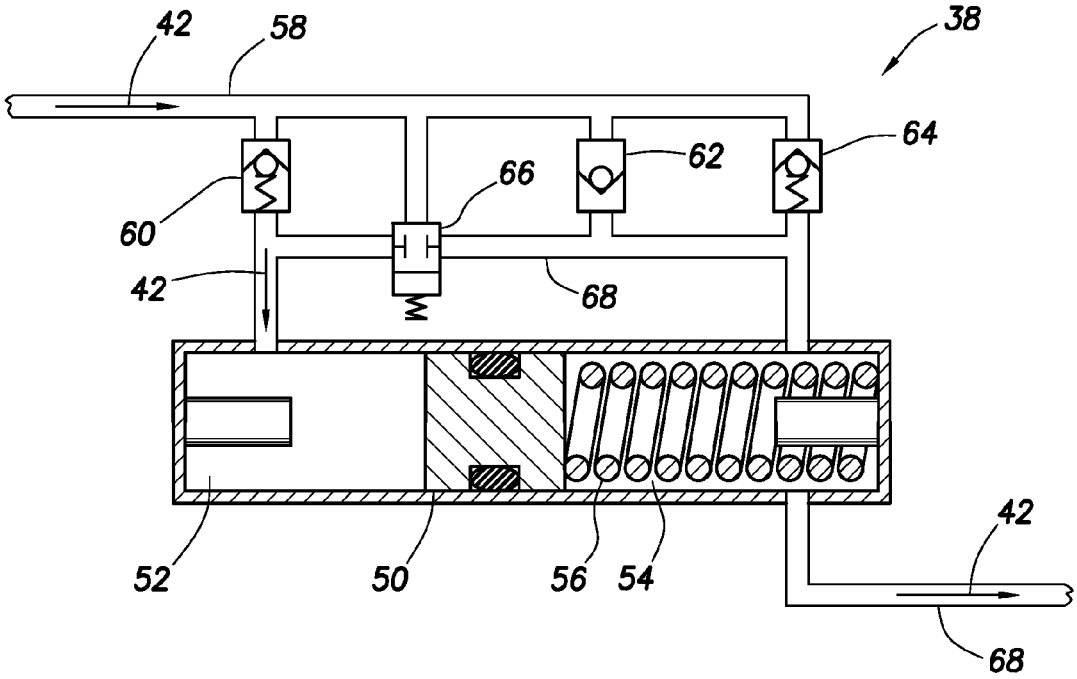

The valve 66 is piloted by pressure in the fluid line 58. That is, when pressure in the fluid line 58 is below a certain pressure (such as, 500 psi), the valve 66 is open as depicted in FIG. 4. However, when pressure in the fluid line 58 is at or above that certain pressure, the valve 66 is closed as depicted in FIG. 5.

The relief valve 60 is connected between the line 58 and the chamber 52 on one side of the valve 66. The check valve 62 and relief valve 64 are connected between the line 58 and the chamber 54 on an opposite side of the valve 66.

The relief valve 60 remains closed unless pressure in the line 58 is at or above a certain pressure (such as, 1000 psi), which causes the valve to open. The relief valve 64 is set to a higher opening pressure (such as, 9000 psi). The check valve 62 prevents flow from the line 58 to the chamber 54, but permits flow from the chamber 54 to the line 58.

When used in the configuration of FIG. 2, the pressure source 40 would be connected via the control line 28 to the fluid line 58 (or the control line and fluid line could be a single component), and another fluid line 68 of the metering device 38 would be connected to the chamber 34 via the line 44 (or the lines 44, 68 could be a single component). When used in the configuration of FIG. 3, the metering device 38 would be connected to the chamber 36 via the lines 46, 58 (or these could be a single line), and fluid 42 would be discharged via the lines 48, 68 (or these could be a single line).

Referring now to FIG. 5, sufficient pressure has been applied to the line 58 to close the pilot-operated valve 66 and then open the relief valve 60. Closing the pilot-operated valve 66 allows a pressure differential to be applied across the piston 50 because the chambers 52, 54 are thus isolated from each other.

Note that in FIG. 4, the chambers 52, 54 are in communication with each other via the pilot-operated valve 66, and so there is no pressure differential across the piston 50, and the piston is displaced all the way to the left by the biasing device 56. In FIG. 5, however, the pilot-operated valve 66 is closed and the relief valve 60 is open due to the pressure applied to the line 58, and this pressure is applied to the chamber 52, thereby causing the piston 50 to displace rightward and discharge the fluid 42 from the chamber 54 via the line 68.

When the piston 50 is fully displaced to the right, a certain predetermined volume of the fluid 42 will be discharged from the metering device 38 via the line 68. Pressure in the line 58 can then be released, or at least reduced.

Figure 6:
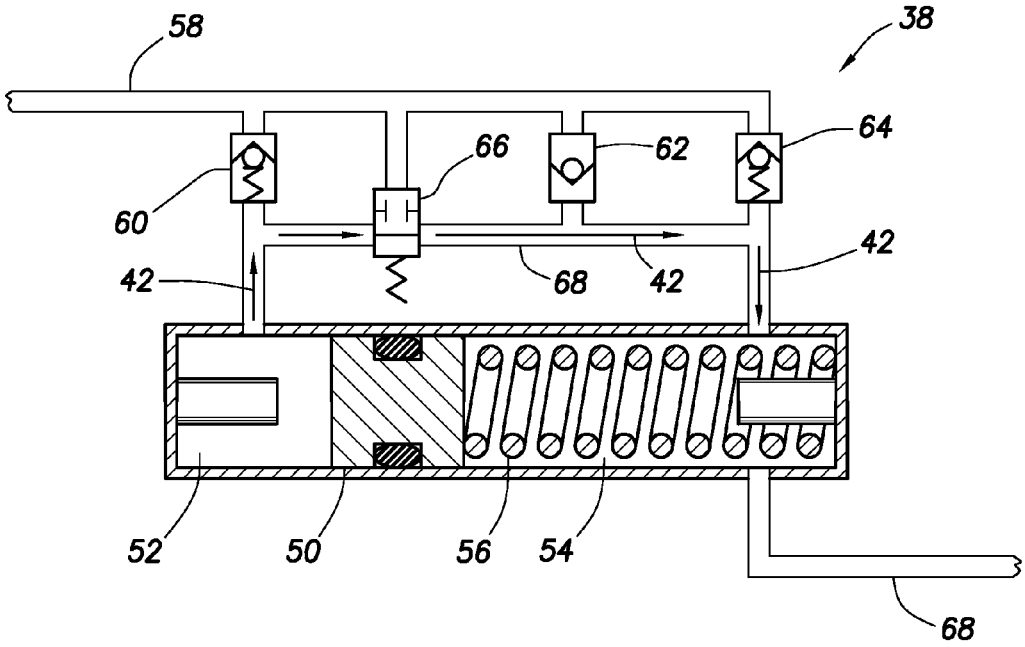

Referring now to FIG. 6, the pressure in the line 58 has been reduced sufficiently to close the relief valve 60 and then open the pilot-operated valve 66. The chambers 52, 54 are now in communication with each other, and the piston 50 is displaced back to the left by the biasing device 56, with the fluid 42 transferring from the chamber 52 to the chamber 54 via the valve 66 and line 68. Eventually, the piston 50 will displace all the way to the left (as depicted in FIG. 4).

This process can be repeated as many times as desired to repeatedly discharge the known volume of the fluid 42 from the metering device 38. It will be appreciated that such repeated discharges of fluid 42 can be used to incrementally displace the piston 32 of the actuator 22 to thereby incrementally displace the closure 24 of the flow control device 20. Of course, the discharge of fluid 42 from the metering device 38 may be used for other purposes in keeping with the principles of this disclosure.

Figure 7:
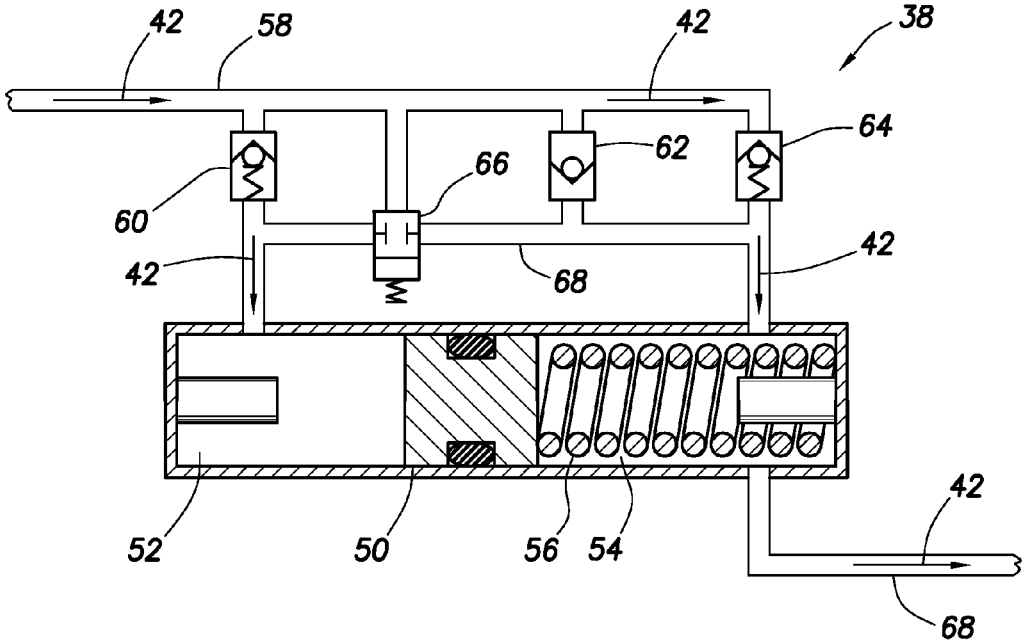

Referring now to FIG. 7, a contingency procedure is depicted in which the piston 50 has become stuck, or in which it is desired to circumvent the metering capabilities of the metering device 38. For example, pressure applied via the relief valve 60 to the chamber 52 will not displace the piston 50 due to, e.g., the piston seizing, an obstruction being encountered, etc.

In the contingency procedure, pressure in the line 58 is increased above the pressure required to open the relief valve 60, until sufficient pressure is applied to open the other relief valve 64. With the relief valve 64 open, the fluid 42 can flow from the line 58 to the chamber 54 via the valve 64. The fluid 42 can then be discharged from the metering device 38 via the line 68.

Although, using this contingency procedure, a known volume of the fluid 42 may not be discharged, at least the actuator 22 can be operated using the discharged fluid (for example, to fully open or close the flow control device 20). This capability could be very important in an emergency situation, or if it is desired to maintain a degree of operability of the well tool 18 until the tubular string 12 can be retrieved from the well for maintenance.

Figure 8:
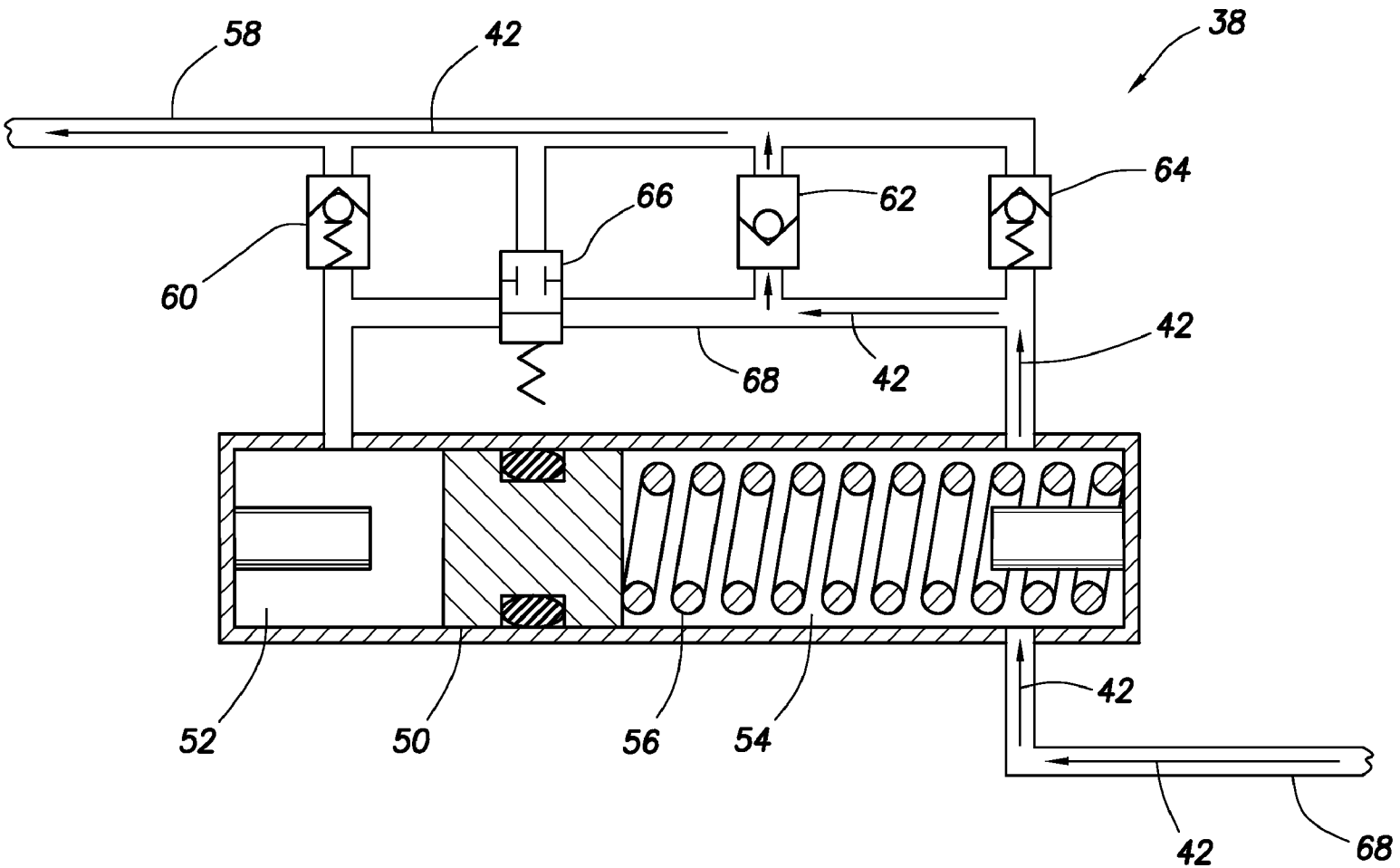

Referring now to FIG. 8, the fluid 42 can be flowed from the line 68 to the line 58 through the metering device 38 at any time (assuming pressure in the line 58 is not greater than pressure in the line 68). Specifically, the check valve 62 allows flow from the chamber 54 to the line 58 whether or not any of the other valves 60, 64, 66 are open.

In this manner, the piston 32 of the actuator 22 can be incrementally displaced in one direction by repeatedly applying pressure to the line 58, and the piston can be displaced fully and continuously in the opposite direction by flowing the fluid 42 through the metering device 38 from the line 68 to the line 58.

It may now be fully appreciated that the above disclosure provides improvements to the art of fluid metering in subterranean wells. The metering device 38 uniquely permits repeated discharges of known volumes of fluid 42, allows the fluid to be flowed in a reverse direction relatively unimpeded, and provides for a contingency operation in the event of a malfunction of the metering device, or if it is otherwise desired to bypass the metering device. Furthermore, the metering device 38 can be constructed using readily available components (such as, relief valves, pilot-operated valve, check valve, etc.), although these components can be specially constructed, if desired.

The above disclosure describes a method of actuating a well tool 18, with the method including the steps of: increasing pressure in a fluid line 58 of a fluid metering device 38; closing a pilot-operated valve 66 in response to the pressure increase; and discharging a predetermined volume of fluid 42 from the metering device 38 in response to the pressure increase and the valve closing.

The valve closing may include isolating first and second chambers 52, 54 from each other. The metering device 38 may include a piston 50 which separates the first and second chambers 52, 54.

The pressure increasing step may include increasing pressure in the first chamber 52. The fluid discharging step may include discharging the predetermined volume of fluid 42 from the second chamber 54.

The pressure increasing step may include opening a first relief valve 60 in response to pressure in the fluid line 58 being at least a first predetermined pressure. The pilot-operated valve 66 closing step is preferably performed prior to the first relief valve 60 opening step.

The method may include the step of increasing pressure in the fluid line 58 to at least a second predetermined pressure greater than the first predetermined pressure, thereby applying at least the second predetermined pressure to an actuator 22 of the well tool 18. The step of increasing pressure in the fluid line 58 to at least a second predetermined pressure may include opening a second relief valve 64.

Also described by the above disclosure is a fluid metering device 38 for a well tool 18. The metering device 38 includes a piston 50 separating first and second chambers 52, 54 and a pilot-operated valve 66 which selectively prevents fluid communication between the first and second chambers 52, 54 in response to at least a first predetermined pressure being applied to a fluid line 58 of the metering device 38. The valve 66 permits fluid communication through the valve 66 between the first and second chambers 52, 54 in response to pressure in the fluid line 58 being less than the first predetermined pressure.

The valve 66 may permit fluid flow from the first chamber 52 to the second chamber 54 through the valve 66, and fluid flow from the second chamber 54 to the first chamber 52 through the valve 66, in response to less than the first predetermined pressure being applied to the fluid line 58.

The metering device 38 may discharge a predetermined volume of fluid 42 in response to at least a second predetermined pressure being applied to the fluid line 58, with the second predetermined pressure being greater than or equal to the first predetermined pressure.

The metering device 38 may include a first relief valve 60 which selectively permits fluid flow from the fluid line 58 to the first chamber 52 in response to at least the second predetermined pressure being applied to the fluid line 58. The first relief valve 60 also prevents fluid communication through the first relief valve 60 between the fluid line 58 and the first chamber 52 in response to pressure in the fluid line 58 being less than the second predetermined pressure.

The metering device 38 may also include a second relief valve 64 which selectively permits fluid flow from the fluid line 58 to the second chamber 54 in response to at least a third predetermined pressure being applied to the fluid line 58. The second relief valve 64 also prevents fluid communication through the second relief valve 64 between the fluid line 58 and the second chamber 54 in response to pressure in the fluid line 58 being less than the third predetermined pressure, with the third predetermined pressure being greater than the second predetermined pressure.

The metering device 38 may also include a check valve 62 which permits fluid flow from the second chamber 54 to the fluid line 58 through the check valve 62, and which prevents fluid flow from the fluid line 58 to the second chamber 54 through the check valve 62.

The piston 50 may displace and discharge a predetermined volume of fluid 42 from the second chamber 54 in response to at least a second predetermined pressure being applied to the fluid line 58, with the second predetermined pressure being greater than the first predetermined pressure.

The above disclosure also describes a well tool 18 which includes an actuator 22 for operating the well tool 18, and a fluid metering device 38 connected to the actuator 22. The fluid metering device 38 includes a piston 50 separating first and second chambers 52, 54, and a pilot-operated valve 66 which selectively prevents fluid communication between the first and second chambers 52, 54 in response to at least a predetermined pressure being applied to a fluid line 58 of the metering device 38, and which permits fluid communication through the valve 66 between the first and second chambers 52, 54 in response to pressure in the fluid line 58 being less than the predetermined pressure.

It is to be understood that the various embodiments described herein may be utilized in various orientations, such as inclined, inverted, horizontal, vertical, etc., and in various configurations, without departing from the principles of the present disclosure. The embodiments are described merely as examples of useful applications of the principles of the disclosure, which are not limited to any specific details of these embodiments.

In the above description of the representative embodiments of the disclosure, directional terms, such as "above," "below," "upper," "lower," etc., are used for convenience in referring to the accompanying drawings.

Of course, a person skilled in the art would, upon a careful consideration of the above description of representative embodiments, readily appreciate that many modifications, additions, substitutions, deletions, and other changes may be made to these specific embodiments, and such changes are within the scope of the principles of the present disclosure. Accordingly, the foregoing detailed description is to be clearly understood as being given by way of illustration and example only, the spirit and scope of the present invention being limited solely by the appended claims and their equivalents.

What is claimed is:

1. A method of operating a well tool, the method comprising the steps of:

interconnecting a fluid metering device in a single fluid line of an actuator of the well tool;

increasing pressure at an inlet of the metering device;

closing a pilot-operated valve in response to the pressure increasing step, and isolating first and second chambers from each other, wherein the metering device includes a piston which separates the first and second chambers; and discharging a predetermined volume of fluid from an outlet of the metering device in response to the pressure increasing and valve closing steps.

2. The method of claim 1, wherein the pressure increasing step further comprises increasing pressure in the first chamber, and wherein the discharging step further comprises discharging the predetermined volume of fluid from the second chamber.

3. The method of claim 1, wherein the pressure increasing step further comprises opening a first relief valve in response to pressure at the inlet of the metering device being at least a first predetermined pressure.

4. The method of claim 3, wherein the pilot-operated valve closing step is performed prior to the first relief valve opening step.

5. The method of claim 3, further comprising the step of increasing pressure at the inlet of the metering device to at least a second predetermined pressure greater than the first predetermined pressure, thereby applying at least the second predetermined pressure to the actuator of the well tool.

6. The method of claim 5, wherein the step of increasing pressure at the inlet of the metering device to at least a second predetermined pressure further comprises opening a second relief valve.

7. A fluid metering device for a well tool, comprising:

a piston separating first and second chambers, the piston being configured to meter a predetermined volume of fluid;

a pilot-operated valve which selectively prevents fluid communication between the first and second chambers in response to at least a first predetermined pressure being applied to a fluid line of the metering device, and which permits fluid communication through the valve between the first and second chambers in response to pressure in the fluid line being less than the first predetermined pressure; and a fluid passageway of the metering device connecting the fluid line and the first chamber.

8. The metering device of claim 7, wherein the valve permits fluid flow from the first chamber to the second chamber through the valve, and fluid flow from the second chamber to the first chamber through the valve, when less than the first predetermined pressure is applied to the fluid line.

9. The metering device of claim 7, wherein the metering device discharges a predetermined volume of fluid from the metering device in response to at least a second predetermined pressure being applied to the fluid line, the second predetermined pressure being greater than or equal to the first predetermined pressure.

10. The metering device of claim 9, further comprising a first relief valve which selectively permits fluid flow from the fluid line to the first chamber in response to at least the second predetermined pressure being applied to the fluid line, and which prevents fluid communication through the first relief valve between the fluid line and the first chamber in response to pressure in the fluid line being less than the second predetermined pressure.

11. The metering device of claim 10, further comprising a second relief valve which selectively permits fluid flow from the fluid line to the second chamber in response to at least a third predetermined pressure being applied to the fluid line, and which prevents fluid communication through the second relief valve between the fluid line and the second chamber in response to pressure in the fluid line being less than the third predetermined pressure, and wherein the third predetermined pressure is greater than the second predetermined pressure.

12. The metering device of claim 11, further comprising a check valve which permits fluid flow from the second chamber to the fluid line through the check valve, and which prevents fluid flow from the fluid line to the second chamber through the check valve.

13. The metering device of claim 7, wherein the piston displaces and discharges a predetermined volume of fluid from the second chamber in response to at least a second predetermined pressure being applied to the fluid line, the second predetermined pressure being greater than the first predetermined pressure.

14. A well tool, comprising:

an actuator for operating the well tool; and a fluid metering device connected to the actuator, the fluid metering device including a piston separating first and second chambers, and a pilot-operated valve which selectively prevents fluid communication between the first and second chambers in response to at least a first predetermined pressure being applied to a fluid line of the metering device, and which permits fluid communication through the valve between the first and second chambers in response to pressure in the fluid line being less than the first predetermined pressure, wherein the metering device discharges a predetermined volume of fluid from the metering device in response to at least a second predetermined pressure being applied to the fluid line, the second predetermined pressure being greater than the first predetermined pressure, wherein the metering device further comprises a first relief valve which selectively permits fluid flow from the fluid line to the first chamber in response to at least the second predetermined pressure being applied to the fluid line, and which prevents fluid communication through the first relief valve between the fluid line and the first chamber in response to pressure in the fluid line being less than the second predetermined pressure, and wherein the metering device further comprises a second relief valve which selectively permits fluid flow from the fluid line to the second chamber in response to at least a third predetermined pressure being applied to the fluid line, and which prevents fluid communication through the second relief valve between the fluid line and the second chamber in response to pressure in the fluid line being less than the third predetermined pressure, and wherein the third predetermined pressure is greater than the second predetermined pressure.

15. The well tool of claim 14, wherein the valve prevents fluid flow from the first chamber to the second chamber through the valve, and fluid flow from the second chamber to the first chamber through the valve, in response to the first predetermined pressure being applied to the fluid line.

16. The well tool of claim 14, wherein the metering device further comprises a check valve which permits fluid flow from the second chamber to the fluid line through the check valve, and which prevents fluid flow from the fluid line to the second chamber through the check valve.

17. The well tool of claim 14, wherein the piston displaces and discharges a predetermined volume of fluid from the second chamber in response to at least a second predetermined pressure being applied to the fluid line, the second predetermined pressure being greater than the first predetermined pressure.

* * * * *